US006732995B2

(12) United States Patent
Takagi

(10) Patent No.: US 6,732,995 B2
(45) Date of Patent: May 11, 2004

(54) CASTING SUPPORT AND CASTING FORM

(75) Inventor: Kyozaburo Takagi, Centerville, OH (US)

(73) Assignee: Fukuvi USA, Inc., Huber Heights, OH (US)

( * ) Notice: Subject to any disclaimer, the term of this patent is extended or adjusted under 35 U.S.C. 154(b) by 13 days.

(21) Appl. No.: 10/185,235

(22) Filed: Jun. 28, 2002

(65) Prior Publication Data

US 2004/0000626 A1 Jan. 1, 2004

(51) Int. Cl.[7] ..... B28B 7/02
(52) U.S. Cl. ..... 249/139; 249/189; 249/219.1
(58) Field of Search ..... 249/3, 139, 189, 249/210, 219.1; 52/127.2, 699

(56) References Cited

U.S. PATENT DOCUMENTS

| | | | | | |
|---|---|---|---|---|---|
| 3,300,920 | A | * | 1/1967 | Skaare | 52/150 |
| 4,579,312 | A | * | 4/1986 | White | 249/6 |
| 4,846,437 | A | * | 7/1989 | Fitzgerald | 249/3 |
| 4,996,770 | A | * | 3/1991 | McCracken | 29/897.34 |
| 5,817,247 | A | * | 10/1998 | Colatruglio | 249/4 |
| 6,536,737 | B1 | * | 3/2003 | Davis | 249/3 |
| 6,540,201 | B1 | * | 4/2003 | Gagnon et al. | 249/139 |

OTHER PUBLICATIONS

Form Alignment Cleats: Panel Systems, Tilt–Up & Precast Concrete Products, http://www.panelsystemsinc.com/cleats.html, Mar. 5, 2002.

* cited by examiner

*Primary Examiner*—Robert Davis
*Assistant Examiner*—Donald Heckenberg
(74) *Attorney, Agent, or Firm*—Dinsmore & Shohl LLP

(57) ABSTRACT

A casting support is provided including a brace and a bracket. The brace includes bracing end portions and the bracket includes first and second bracing faces that include one or more pairs of bracing projections. A distance between the bracing end portions of the brace is greater than a distance between opposite bracing projections on the first and second bracing faces. The brace is positioned to lend structural support to the bracket by urging it past the bracing projections into a secure bracing position. A casting form is also provided including a plurality of form panels and a plurality of casting supports. The casting supports are configured to support the form panels in a substantially vertical orientation and each of the casting supports includes a brace and a bracket. A casting form is also provided where each of the casting supports comprises a brace and a bracket and each bracket comprises an integrally-formed form face spaced from and oriented parallel to a first bracing face of the bracket.

33 Claims, 5 Drawing Sheets

CASTING SUPPORT AND CASTING FORM

BACKGROUND OF THE INVENTION

The present invention relates forms and form supports used for creating cured pre-cast structures. More specifically, the present invention relates to configurations of pre-cast forms and form supports for use in forming and curing concrete panels.

Many residential and commercial construction methods involve the use pre-cast structures. Pre-cast panels, for example, are integral to the tilt-up construction process. In the tilt-up approach, concrete forms are arranged on a flat casting surface in the shape and dimension of the desired tilt-up panel and filled with concrete. When the concrete cures, the panel and the form are separated and the panel is tilted up into a preferred, typically vertical, orientation, where it can be joined to structural frames or other panels. The present inventor has recognized a need for improved form and form supports for use in creating pre-cast structures.

BRIEF SUMMARY OF THE INVENTION

This need is met by the present invention wherein improved forms and form supports are provided for use in forming pre-cast structures. In accordance with one embodiment of the present invention, a casting support is provided comprising a brace and a bracket. The brace includes bracing end portions defined on opposite extremities of the brace. The bracket includes first and second bracing faces that include at least one pair of bracing projections. A distance between the bracing end portions of the brace is greater than a distance defined between a bracing projection on the first bracing face to a bracing projection on the second bracing face. The brace is positioned to lend structural support to the bracket by urging it past the bracing projections into a secure bracing postion.

In accordance with another embodiment of the present invention, a casting form is provided comprising a plurality of form panels and a plurality of casting supports. The casting supports are configured to support the form panels in a substantially vertical orientation and each of the casting supports comprises a brace and a bracket according to the present invention.

In accordance with yet another embodiment of the present invention, a casting form is provided comprising a plurality of casting supports. Each of the casting supports comprises a brace and a bracket and each bracket comprises an integrally-formed form face spaced from and oriented parallel to a first bracing face of the bracket.

Accordingly, it is an object of the present invention to provide improved forms and form supports for use in fabricating pre-cast panels. Other objects of the present invention will be apparent in light of the description of the invention embodied herein.

BRIEF DESCRIPTION OF THE SEVERAL VIEWS OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
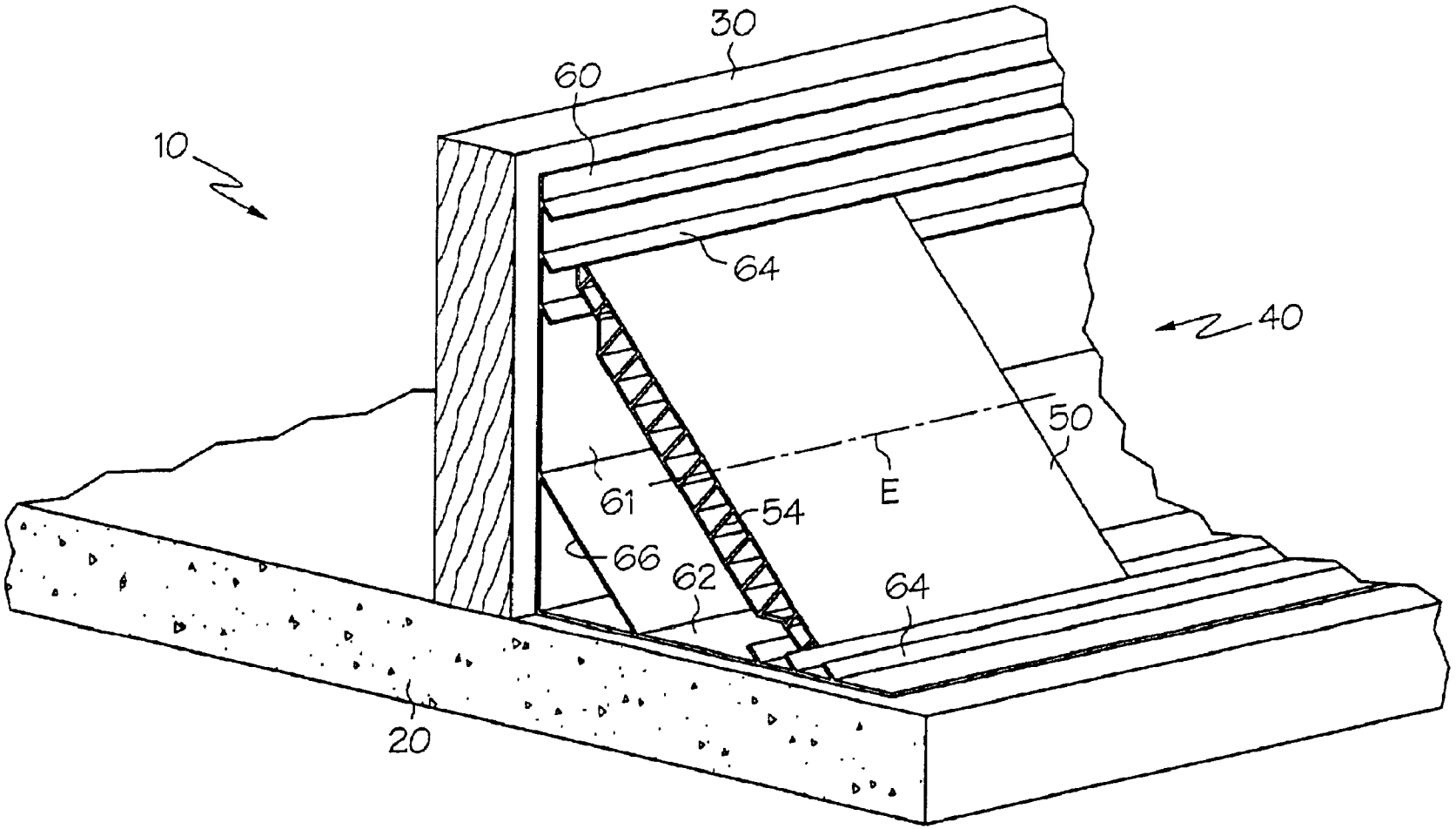
FIG. 1 is a three-dimensional illustration, partially broken away, of a casting form and casting support according to one embodiment of the present invention.

Referring initially to FIG. 1, a portion of a casting form 10 resting on a concrete slab 20, or other surface, is illustrated. As will be appreciated by those skilled in the art of casting, particularly concrete casting, casting forms include a plurality of form panels 30 arranged to define a confined space. The confined space, typically in the shape of a rectangle, is filled with concrete or another casting material. The casting material within the form 10 is cured and made available for use by partially or fully disassembling the form 10 and removing the cured body from the confines of the form panels 30.

The casting form 10 illustrated in FIG. 1 includes the form panel 30, typically a wooden plank, and a casting support 40. As will be described in detail herein, the casting support 40 comprises a brace 50 and a bracket 60. The brace 50 and bracket 60 cooperate with the form panel 30 to define a secure and properly oriented casting form 10.

Figure 3:
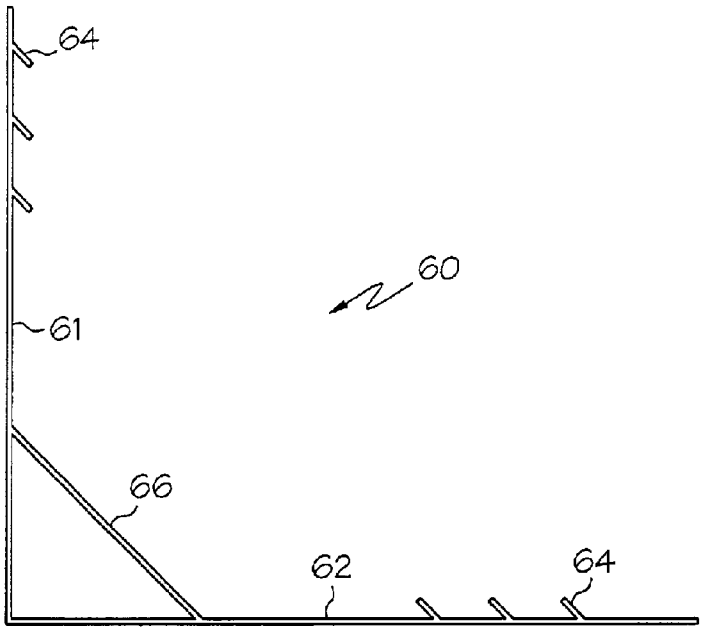
FIG. 3 is a side view of the bracket illustrated as part of the casting support of FIG. 1.
Figure 2:
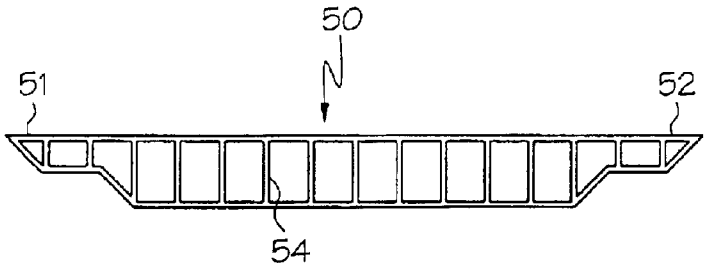
FIG. 2 is a side view of the brace illustrated as part of the casting support of FIG. 1.

Referring to FIGS. 1–3, the brace 50 includes bracing end portions 51, 52 defined on opposite extremities of the brace 50. The brace also includes intermediate support members 54, adding structural integrity and uniformity to the brace 50. The bracket 60 includes first and second bracing faces 61, 62. The bracing faces 61, 62 include a series of spaced apart bracing projections 64. The bracing projections 64 may be arranged in pairs, each projection of each pair being present on a different bracing face 61, 62. In the illustrated embodiment, the bracing projections 64 comprise bracing tabs arranged to flex away from each other, increasing the distance defined between a bracing tab on the first bracing face to a bracing tab on the second bracing face. It is contemplated, however, that the bracing projections may be presented as any structural form that projects from the bracing face 61, 62 upon which it is formed or to which it is secured.

The length of the brace 50 between the bracing end portions 51, 52 is selected to ensure secure engagement of the brace 50 with at least one of the pairs of bracing projections 64 of the bracket 60. Specifically, the distance between the bracing end portions 51, 52 of the brace 50 is at least as large as, and preferably slightly large than, the distance between a bracing projection 64 on the first bracing face 61 and a bracing projection 64 on the second bracing face 62. In this manner, it becomes necessary to forcibly urge the brace 50 past the pair of appropriately-spaced bracing projections and the brace 50 may be lodged securely between the first and second bracing faces 61, 62 of the bracket 60.

Typically, the distance between the first and second bracing faces 61, 62 at a point on the first bracing face 61 adjacent to a bracing projection 64 to a point on the second bracing face 62 adjacent to another of the bracing projections 64 is at least as large as, and preferably slightly larger than, the distance between the bracing end portions 51, 52 of the brace 50. In this manner, the brace 50 may rest between the bracing faces without interfering with the right angle geometry of the bracket. Although, the first and second bracing faces typically lie in substantially orthogonal planes, it is contemplated that the bracket 60 may define a slightly acute geometry and that the brace 50 may be designed to forcibly urge the bracket into a right angle orientation. In which case, one or both of the bracing faces 61, 62 should be configured to yield upon application of pressure from the brace 50 as it is urged past the bracing projections 64. It may also be preferable to provide yielding bracing faces 61, 62 to provide a means by which the distance defined between pairs of bracing projections 64 may be increased as the brace 50 is urged into a secure position between the faces 61, 62.

The brace 50 and bracket 60 may be formed through a conventional extrusion process and, as such, each define extrudable cross sectional profiles. For the purposes of defining and describing the present invention, it is noted that a structural member defines an extrudable cross sectional profile if respective cross sections of the member, taken along a length or width-wise axis of the member, each define substantially identical dimensions. In which case, the member defining the extrudable profile may be produced by an extrusion process where a semi-soft plastic is forced through the orifice of an extrusion die to produce a continuously formed piece having a cross-sectional shape defined by the orifice or other shaping members down line of the orifice. It is contemplated that a structural member having an extrudable cross-sectional profile may also include portions along its axis that are subject to post extrusion cutting, drilling, bending, deforming, etc.

Figure 5:
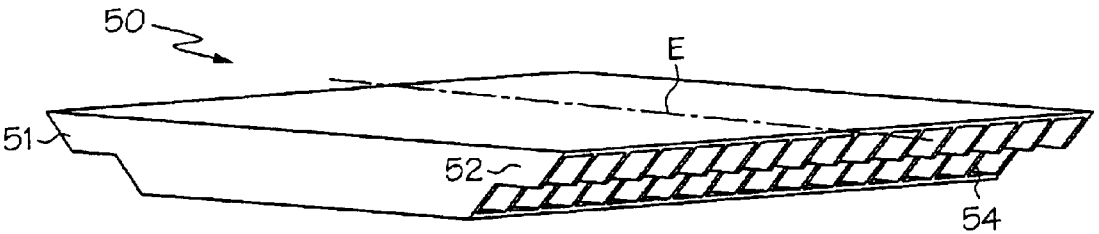
FIG. 5 is a three-dimensional view of a further alternative brace configuration.

Referring to FIGS. 1 and 5, it is noted that the brace 50 may be extruded along one of two different extrusion axes E. Specifically, referring to FIG. 1, the brace may define an extrudable cross-sectional profile defined by cross sections spaced along an extrusion axis E perpendicular to an axis extending between the bracing end portions. Referring to FIG. 5, the brace 50 may define an extrudable cross-sectional profile defined by cross sections spaced along an extrusion axis E extending between the bracing end portions 51, 52.

Figure 4:
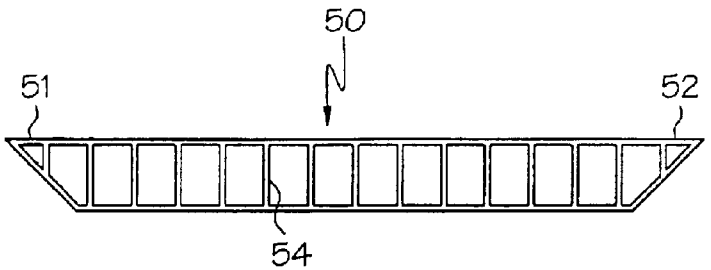
FIG. 4 is a side view of an alternative brace configuration.

Referring to FIGS. 2 and 4, it is noted that the bracing end portions 51, 52 of the brace 50 may be provided as a mitered surface. The mitered surfaces may be compound, as is illustrated in FIG. 2, or simple, as is illustrated in FIG. 4. The compound mitered surface of FIG. 2 allows for increased structural thickness while avoiding interference with unused projections 64 on the bracing faces 61, 62 of the bracket 60.

It is noted that the bracket 60 may be provided with additional integrally-formed structural support members. For example, referring to FIGS. 1 and 3, an integrally-formed supplemental brace 66 may be formed so as to extend from the first bracing face 61 to the second bracing face 62.

Figure 6A:
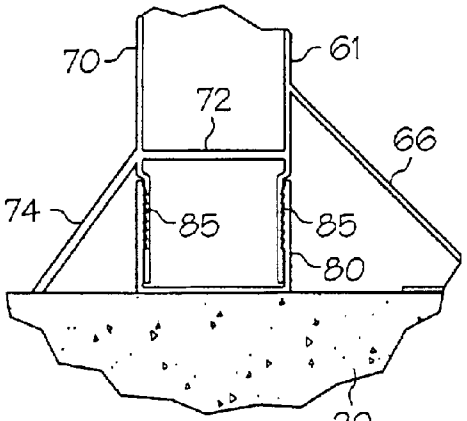
FIG. 6A is a broken-away, expanded view of a portion of the casting form of FIG. 6.
Figure 6:
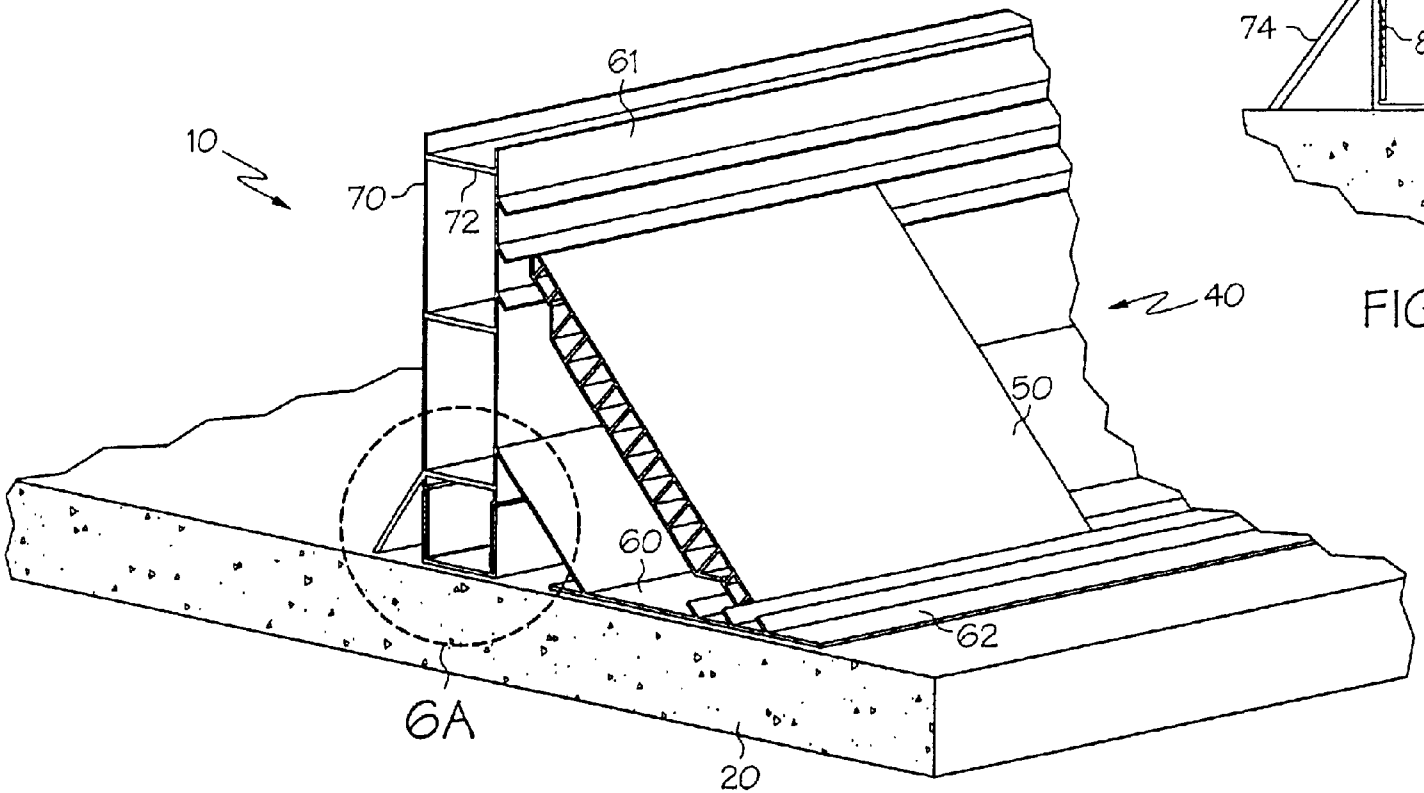
FIG. 6 is a three-dimensional illustration, partially broken away, of casting form and casting support according to an alternative embodiment of the present invention.
Figure 7:
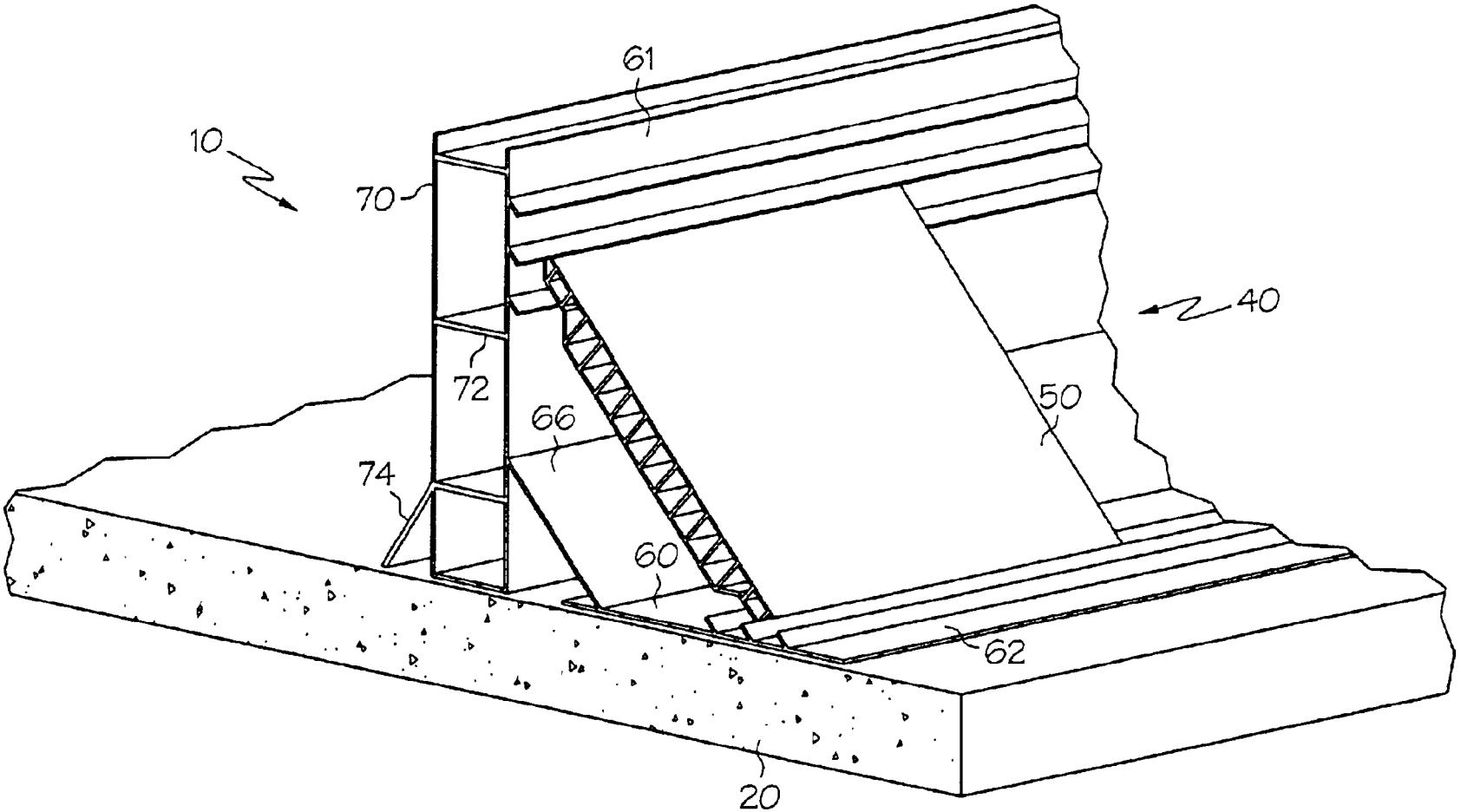
FIGS. 7 and 8 are three-dimensional illustrations, partially broken away, of casting form and casting supports according to further alternative embodiments of the present invention.

Referring to the embodiments of FIGS. 6 and 7, the bracket 60 may be configured to eliminate the need for the separate form panel 30 of the FIG. 1 embodiment. Specifically, the bracket 60 may be configured to include an integrally formed, vertically-oriented form face 70 spaced from and oriented parallel to the first bracing face 61. The form face 70 defines a major bounding surface of the casting form 10. Intermediate supports 72 of varying number, shapes, sizes, and orientations may be provided to support the form face 70. A conventional chamfer portion 74 may also be formed integrally with the bracket 60.

In the embodiment of FIG. 6, the casting form 10 further comprises a separate base clip 80 configured to engage the bracket 60. The engagement is preferably friction fit and may be enhanced by providing complementary locking projections 85 on the base clip 80 and on downward projections of the first bracing face 61 and form face 70 of the bracket 60. In this manner, the base clip 80 may be secured to the slab 20 with, screws, nails, adhesives, tapes, or other conventional fasteners and the bracket 60 may subsequently be secured to the base clip 80 without the use of additional fasteners. FIG. 7 illustrates an embodiment of the present invention that does not employ a separate base clip 80. Rather, use of the casting form 10 illustrated in FIG. 7 will typically require that the bracket 60 be secured to the slab 20 with conventional fasteners.

Figure 8:
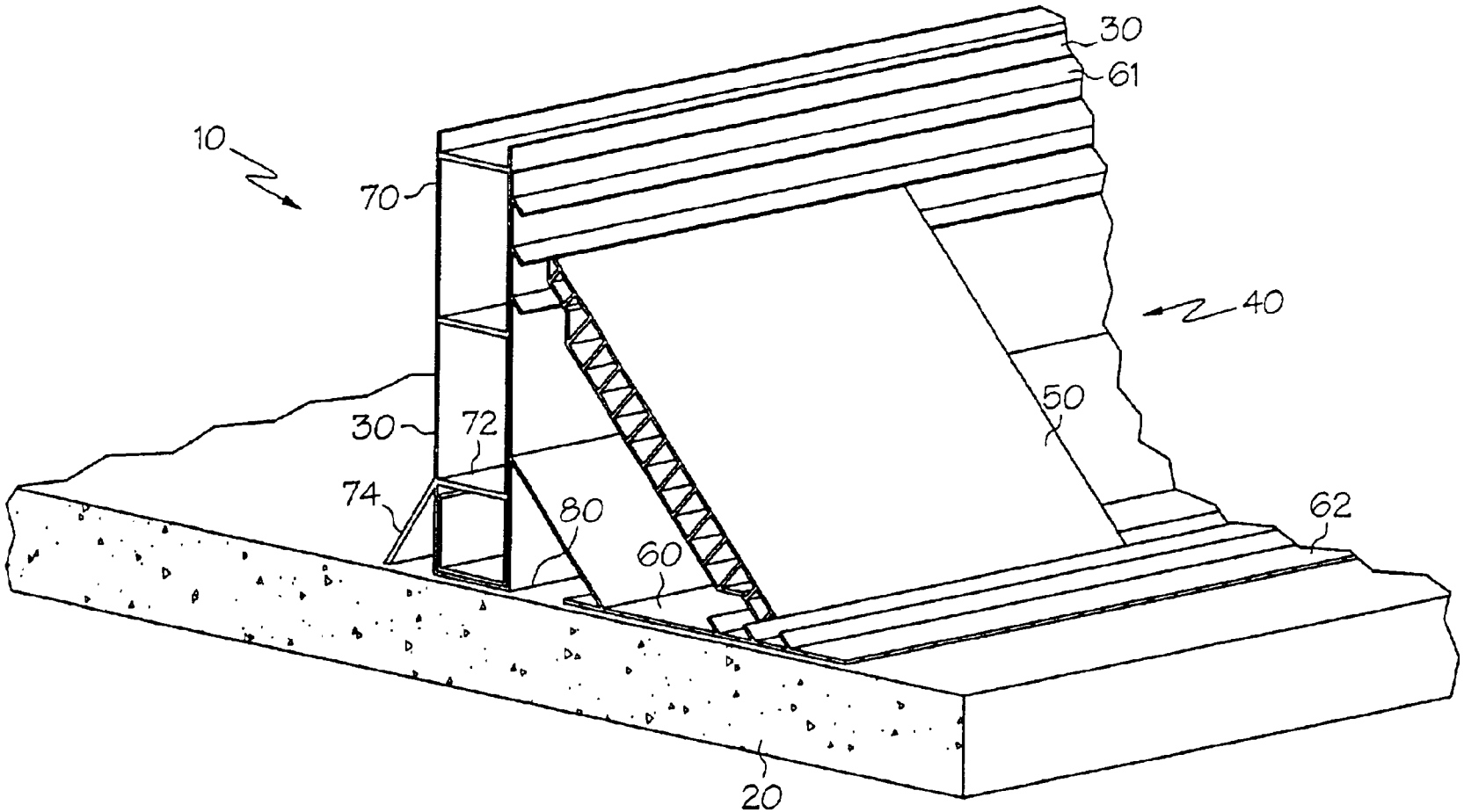

In the embodiment of FIG. 8, the bracket 60 comprises an integrally formed base clip 80. The casting form 10 includes a form panel 30 separate from the brace 50 and the bracket 60. The form panel may comprise an extruded plastic structure and defines a form face 70 spaced from and oriented parallel to the first bracing face 51. The base clip 80 is configured to engage, and preferably nest about, a lower portion of the form panel 30. Complementary locking projections may be employed in a manner similar to that described above with reference to FIGS. 6 and 6A to secure the form panel 30 to the base clip 80. It is contemplated that a wooden plank may also be utilized as the form panel 30 in the embodiment of FIG. 8.

It is noted that terms like "preferably," "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A casting support comprising a brace and a bracket, wherein:

said brace includes bracing end portions defined on opposite extremities of said brace;

said bracket includes first and second bracing faces;

said first and second bracing faces define a plurality of pairs of bracing projections spaced apart along said first and second bracing faces; and a distance between said bracing end portions of said brace is greater than a distance defined between a bracing projection on said first bracing face to a bracing projection on said second bracing face.

2. A casting support as claimed in claim 1 wherein said brace and said bracket are formed of a plastic material.

3. A casting support as claimed in claim 1 wherein said brace and said bracket each define extrudable cross sectional profiles.

4. A casting support as claimed in claim 3 wherein said brace defines an extrudable cross-sectional profile defined by cross sections spaced along an axis extending between said bracing end portions.

5. A casting support as claimed in claim 1 wherein said brace defines an extrudable cross-sectional profile defined by cross sections spaced along an axis perpendicular to an axis extending between said bracing end portions.

6. A casting support as claimed in claim 1 wherein said first and second bracing faces lie in substantially orthogonal planes.

7. A casting support as claimed in claim 1 wherein said bracket is configured to:

permit said bracing end portions of said brace to be urged into a secure position past a pair of said bracing projections defining a distance there between that is smaller than said distance between said bracing end portions of said brace; and hold said brace in said secure position.

8. A casting support as claimed in claim 1 wherein said bracing projections comprise bracing tabs arranged to flex away from each other, increasing said distance defined between a bracing tab on said first bracing lace to a bracing tab on said second bracing face.

9. A casting support as claimed in claim 1 wherein at least one of said first and second bracing faces is configured to yield upon application of a given pressure to a bracing projection positioned thereon, increasing said distance defined between a bracing projection on said first bracing face and a bracing projection on said second bracing face.

10. A casting support comprising a brace and a bracket, wherein:

said brace includes bracing end portions defined on opposite extremities of said brace;

said bracket includes first and second bracing faces;

said first and second bracing faces include at least one pair of bracing projections;

a distance between said bracing end portions of said brace is greater then a distance defined between a bracing projection on said first bracing face to a bracing projection on said second bracing face; and each of said bracing end portions define a mitered surface.

11. A casting support as claimed in claim 10 wherein said mitered surface extends for a limited portion of a thickness dimension of said brace.

12. A casting support as claimed in claim 10 wherein said mitered surface defines a compound mitered surface.

13. A casting support comprising a brace and a bracket, wherein:

said brace includes bracing end portions defined on opposite extremities of said brace;

said bracket includes first and second bracing faces;

said first and second bracing faces include at least one pair of bracing projections;

a distance between said bracing end portions of said brace is greeter than a distance defined between a bracing projection on said first bracing face to a bracing projection on said second bracing face; and said bracket further comprises an integrally-formed supplemental brace extending from said first bracing face to said second bracing face.

14. A casting support as claimed in claim 1 wherein said bracket further includes a form face spaced from and oriented parallel to said first bracing face.

15. A casting support as claimed in claim 14 wherein said casting support further comprises a base clip configured to engage said bracket.

16. A casting support as claimed in claim 15 wherein said base clip is configured to engage downward projections of said first bracing face and a from face.

17. A casting support as claimed in claim 16 wherein said base clip and said downward projections of said first bracing face and said form face include complementary locking projections.

18. A casting support as claimed in claim 1 wherein said bracket further comprises an integrally formed form face spaced from and oriented parallel to said first bracing face.

19. A casting support comprising a brace and a bracket, wherein:

said brace includes bracing end portions defined art opposite extremities of said brace;

said bracket includes first and second bracing faces;

said first and second bracing faces include at least one pair of bracing projections; and a distance between said bracing end portions of said brace is greater than a distance defined between a bracing projection on said first bracing face to a bracing projection on said second bracing face;

said bracket further comprises an integrally-formed base clip;

said casting support includes a form panel separate from said brace and said bracket; and said form panel defines a form face spaced from end oriented parallel to said first bracing face.

20. A casting support as claimed in claim 19 wherein said base clip is configured to engage a lower portion of said form panel.

21. A casting support as claimed in claim 19 wherein said form panel is configured to nest within said base clip.

22. A casting support as claimed in claim 19 wherein said form panel comprises a plastic form panel defining an extrudable cross-sectional profile.

23. A casting support as claimed in claim 19 wherein said form panel comprises a wooden panel.

24. A casting support as claimed in claim 1 wherein a distance between said first and second bracing faces at a point on said first bracing face adjacent a bracing projection to a point on said second bracing face adjacent another of said bracing projections is at least as large as a distance between said bracing end portions of said brace.

25. A casting form comprising a plurality of form panels and a plurality of casting supports, wherein:

said casting supports are configured to support said form panels in a substantially vertical orientation; and each of said casting supports comprise a brace and a bracket, wherein said brace includes bracing end portions defined on opposite extremities of said brace, said bracket includes first and second bracing faces, said first and second bracing faces define a plurality of pairs of bracing projections spaced apart along said first and second bracing faces, and a distance between said bracing end portions of said brace is greater than a distance defined between a bracing projection on said first bracing face to a bracing projection on said second bracing face.

26. A casting form as claimed in claim 25 wherein said form panels comprise wooden panels.

27. A casting form as claimed in claim 25 wherein said form panels comprise plastic form panels defining extrudable cross-sectional profiles.

28. A casting form as claimed in claim 25 wherein said form panels are configured to engage respective base clips of said casting supports.

29. A casting form as claimed in claim 25 wherein each of said casting supports further comprises an integrally-formed base clip.

30. A casting form as claimed in claim 29 wherein each of said integrally-formed base clips is configured to engage one of said form panels.

31. A casting form comprising a plurality of casting supports, wherein:

each of said casting supports comprises a brace and a bracket;

said bracket comprises an integrally-formed form face spaced from and oriented parallel to a first bracing face of said bracket;

said brace includes bracing end portions defined on opposite extremities of said brace;

said bracket includes first and second bracing faces;

said first and second bracing faces include at least one pair of bracing projections spaced apart along said first and second bracing faces; and a distance between said bracing end portions of said brace is greater than a distance defined between a bracing projection on said first bracing face to a bracing projection on said second bracing face.

32. A casting form as claimed in claim 31 wherein each of said casting supports further comprise a base clip configured to engage said bracket.

33. A casting support comprising a brace and a bracket, wherein:

said brace includes bracing end portions defined on opposite extremities of said brace;

said bracket includes first and second bracing faces that lie in substantially orthogonal planes;

said first bracing face includes at least one bracing projection fixed along a length of said first bracing face;

said second bracing face includes at least one additional bracing projection fixed along a length of said Second bracing face; and said bracing projections comprise bracing tabs arranged to flex away from each other while remaining fixed along said respective bracing faces, increasing a distance defined between a bracing tab on said first bracing face and a bracing tab on said second bracing face.

* * * * *

UNITED STATES PATENT AND TRADEMARK OFFICE

CERTIFICATE OF CORRECTION

PATENT NO. : 6,732,995 B2
DATED : May 11, 2004
INVENTOR(S) : Takagi

It is certified that error appears in the above-identified patent and that said Letters Patent is hereby corrected as shown below:

Column 5,
Line 14, "A casting support as claimed in claim 1 wherein said" should read -- A casting support as claimed in claim 3 wherein said --;
Line 32, "between a bracing tab on said first bracing lace to a bracing" should read -- between a bracing tab on said first bracing face to a bracing --;

Column 6,
Line 14, "said first bracing face and a from face." should read -- said first bracing face and a form face. --;
Line 20, "bracket further comprises an integrally formed form face" should read -- bracket further comprises an integrally-formed form face--;
Line 24, "said brace includes bracing end portions defined art" should read -- said brace includes bracing end portions defined on --;
Line 38, "said form panel defines a form face spaced from end" should read -- said form panel defines a form face spaced from and --

Signed and Sealed this

Twenty-fourth Day of May, 2005

JON W. DUDAS
*Director of the United States Patent and Trademark Office*

UNITED STATES PATENT AND TRADEMARK OFFICE

CERTIFICATE OF CORRECTION

PATENT NO. : 6,732,995 B2
DATED : May 11, 2005
INVENTOR(S) : Kyozaburo Takaga

It is certified that error appears in the above-identified patent and that said Letters Patent is hereby corrected as shown below:

Column 8,
Line 1, "said first and second bracing faces include at least one pair" should read -- said first and second bracing faces define a plurality of pairs --.

Signed and Sealed this

Ninth Day of August, 2005

JON W. DUDAS
*Director of the United States Patent and Trademark Office*